United States Patent [19]

Huber

[11] 4,408,823

[45] Oct. 11, 1983

[54] MULTI-PIECE CONNECTOR AND COVER MEANS

[75] Inventor: John H. Huber, Harrisburg, Pa.

[73] Assignee: AMP Incorporated, Harrisburg, Pa.

[21] Appl. No.: 252,770

[22] Filed: Apr. 10, 1981

[51] Int. Cl.[3] ..... H01R 13/00

[52] U.S. Cl. ..... 339/208

[58] Field of Search ..... 339/97 R, 97 P, 98, 339/99, 208

[56] References Cited

U.S. PATENT DOCUMENTS 4,243,288 1/1981 Lucius et al. ..... 339/99 R

*Primary Examiner*—Joseph H. McGlynn
*Assistant Examiner*—Timothy V. Eley
*Attorney, Agent, or Firm*—Adrian J. LaRue

[57] ABSTRACT

An electrical connector is disclosed of a multi-piece configuration, comprising a connector block having a row of contact-receiving cavities in oppositely-facing surfaces thereof, and a pair of hermaphroditic connector covers for intended assembly over the oppositely-facing block surfaces. The block is provided with parallel rows of receptacle passageways in a frontal face thereof, each accessing a respective cavity. The covers each are provided with a plurality of forwardly-projecting stud projections, serially spaced across a forward end thereof. The projections are inserted into respective receptacle passageways, and cooperate with interior surfaces defining the passageways to define a funnel-shaped profile for guided receipt of terminal pins therethrough.

8 Claims, 7 Drawing Figures

MULTI-PIECE CONNECTOR AND COVER MEANS

BACKGROUND OF THE INVENTION

1. Field of the Invention

The present invention relates to connector assemblies for terminating a flat cable, and more specifically, to multi-piece assemblies including cover means for attachment to a connector block unit.

2. The Prior Art

Flexible flat cable is commonly used within the electrical industry for a variety of transmission applications, and a number of connector configurations are commercially available for terminating such cables. Typically, presently available connectors comprise a block having terminal-receiving cavities, exposed to permit lateral insertion of conductors into the cavities, and into mechanical engagement with contacts located herein. Cover units are typically provided for positionment over the exposed cavities, and such cover units generally provide some means for attachment to the connector block unit. While a variety of techniques are available for latching the cover units to the connector block, no single embodiment presently available satisfies all of the industry's needs.

For example, it is desirable for any connector embodiment to provide a simplicity of design, and to utilize a maximum degree of parts standardization so as to make the connector amenable to mass production. Further, a suitable connector must be of a relatively small dimensional scale, making achievement of a suitable latching between the cover and the connector block all the more difficult.

SUMMARY OF THE INVENTION

The present invention addresses the above problems in providing a connector assembly comprising three basic structural components. A connector block is set forth having a plurality of spaced-apart contact-receiving cavities in oppositely-facing surfaces thereof. The block is further adapted having parallel rows of receptacle passageways extending into a frontal face thereof, each communicating with a respective contact-receiving cavity. A pair of hermaphroditic covers are provided for positionment against respective surfaces of the connector block, and serve to encapsulate the contact-receiving cavities of the block. Each connector cover is structured to provide a series of forwardly-projecting stud projections spaced across a forward end thereof, which interfit into respective receptacle passageways as the connector covers are arcuately brought against the connector block. Each stud projection further provides a flared surface which cooperates with internal surfaces defining the receptacle passageways, to define a funnel-shaped profile for guided receipt of a mating terminal pin therethrough. Thus, the subject invention provides a convenient means for latching a pair of hermaphroditic connector covers to opposite surfaces of a connector block. Moreover, the covers are structured to cooperate with the connector block in defining funnel-shaped openings for receiving terminal pins.

Accordingly, it is an object of the present invention to provide a connector assembly for achieving positive electrical and mechanical termination of a flat transmission cable.

It is a further object of the present invention to provide a connector assembly for the termination of a flat transmission cable having improved cover latching means.

Still a further object of the present invention is to provide a connector assembly for the termination of a flat transmission cable featured having improved means for securing the assembly components together in an assembled state.

Still further, it is an object of the present invention to provide a connector assembly for the termination of a flat transmission cable featured having hermaphroditic cover members.

A still further object of the present invention is to provide a connector assembly for the termination of a flat transmission cable featured having integral means for preventing overengagement between the assembled connector and other terminal members.

Yet a further object of the present invention is to provide a connector assembly for the termination of a flat transmission cable which is economically and readily produced, and which is readily assembled.

These and other objects, which will be apparent to one skilled in the art, are achieved by a preferred embodiment which is described in detail below, and which is illustrated in the accompanying drawings.

BRIEF DESCRIPTION OF THE ACCOMPANYING DRAWINGS

FIG. 2 is an exploded perspective view of the subject multi-piece connector illustrated in FIG. 1.

DETAILED DESCRIPTION OF THE PREFERRED EMBODIMENT

Figure 1:
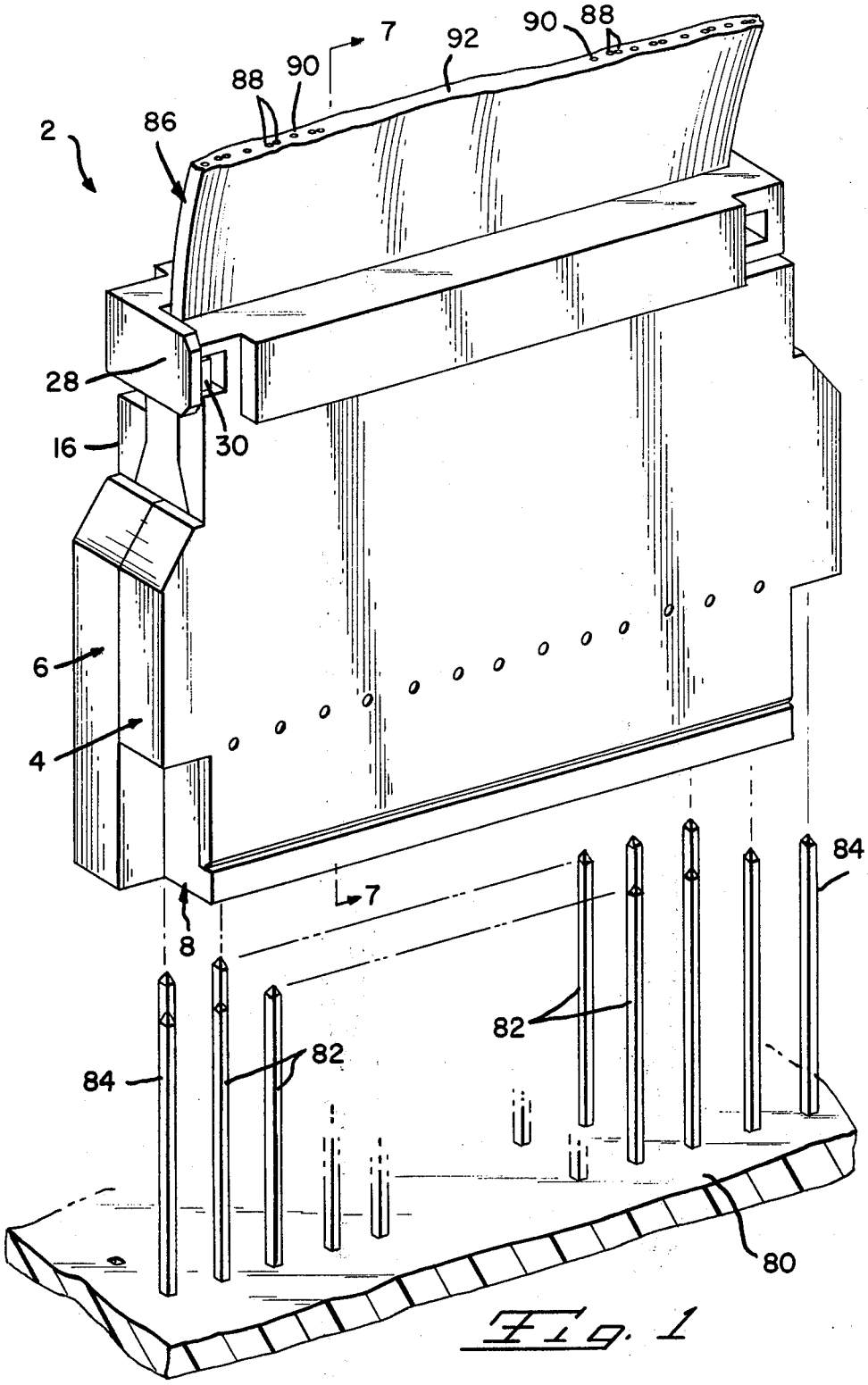
FIG. 1 is an assembled perspective view of the subject multi-piece connector, shown terminating a flat flexible cable.

The subject connector assembly 2, illustrated in FIG. 2, comprises a pair of hermaphroditic cover members 4,6 and a connector body member 8. Each cover member is formed generally having a plate portion 10 extending from a rearward end 12 to a forward end 14, and profiled sides 16 each having a profiled opening 18 therein. Formed integrally with a rearward end of each cover member, a strain relief portion 20 is provided having an inwardly facing surface 22, with a V-shaped ridge 24 of tapered profile extending partially across surface 22 in the transverse direction. An elongate V-shaped recess 26 is also provided within the inwardly facing surface generally colinear with the cover's corresponding ridge, and is of increasing depth therealong in the transverse direction. A cantilever arm 28 is formed to project outwardly from one end of the strain relief portion 20 of each cover member; the arm 28 having an inwardly projecting flange 30 at the free end thereof. Intermediate the plate portion 10 of each cover member 4,6 are a plurality of outwardly directed wedge-shaped stops 32 which are colinearly spaced across the plate portion 10. At the forward end 14 of each cover member are a plurality of spaced-apart, forwardly directed stud projections 34, each having a beveled lower surface 35 so formed for a purpose explained below. A locking detent 36 is further provided each connector cover member at the rearward end thereof. It will be appreciated from FIG. 2 that the subject connector covers are preferably unitarily molded of plastics material having the above described structure. Each cover is profiled having a stop surface 33 formed therein.

Figure 3:
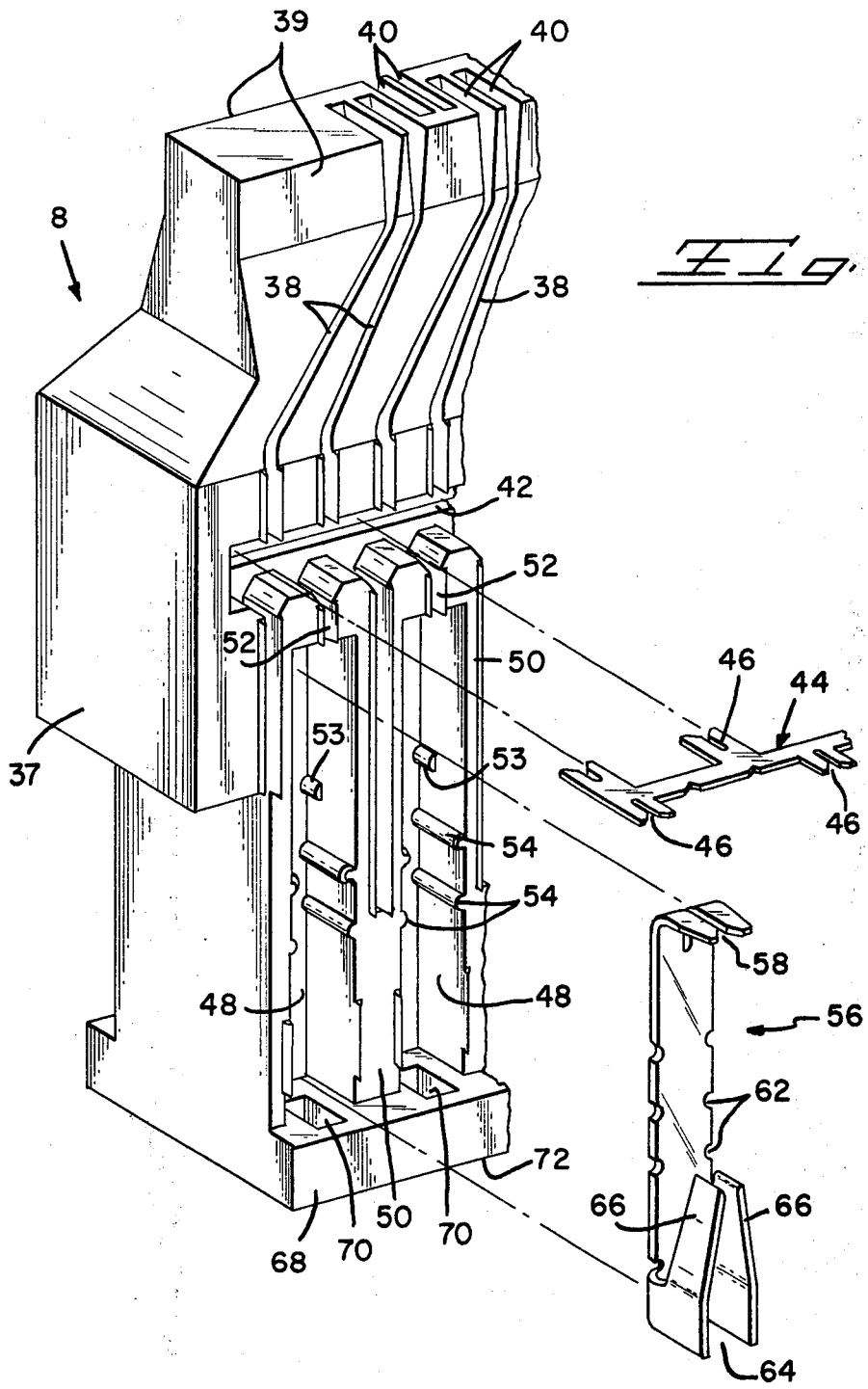
FIG. 3 is a partial perspective view of the subject connector block, illustrating a representative number of contact-receiving cavities having associated bus bar and contact members exploded therefrom.
Figure 4:
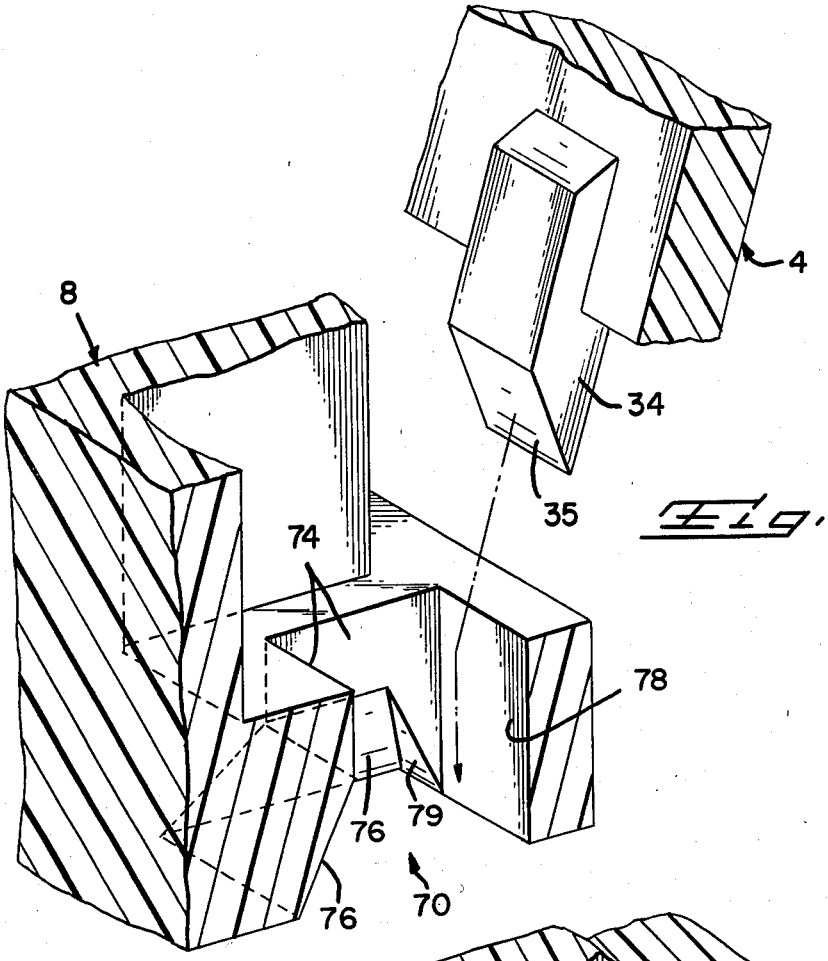
FIG. 4 is a transverse section view through a representative one of the receptacle passageways of the subject connector block, shown having a cover stud projection exploded therefrom.

Referring now to FIGS. 2 and 3, the subject connector body 8 is profiled having an external shoulder 37. Shoulder 37 is necessary for one intended application of the present invention, but it should be noted that the principles of the present invention would be served as well by a body member having a non-contoured side profile. A plurality of conductor-receiving channels 38 are formed within oppositely-facing surfaces 39 of the body 8 (only one surface 39 being shown, however, the opposite surface of the body 8 is similarly configured). Each channel 38 has a funnel entry portion 40. An elongate ground bus slot 42 extends transversely of the connector body within surface 39. As illustrated by FIG. 3, the ground bus bar 44 is stamped from a continuous blank, and includes a plurality of offset ground conductor terminating slots 46. The connector body (FIG. 3) further comprises a plurality of terminal-receiving cavities 48 positioned serially across the connector body 8, adjacent cavities 8 being separated by integral barriers 50. Each terminal-receiving cavity communicates with the bus slot area of the connector body by means of through-channels 52. Opposing retention ribs 53 and overstress preventive alignment ribs 54 are integrally formed down sidewalls of the terminal-receiving channels 48. A plurality of terminal members 56 are intended for use within the connector body, each terminal 56 being configured having a single termination slot 58 at a rearward end for terminating a signal conductor of the subject cable, an intermediate shank portion having oppositely-located alignment tracks 62 formed therein, and a forward female-type receptacle portion 64 comprising inwardly biased tines 66. The connector body 8 includes a forward barrier 68 having an array of profiled passageways 70 formed therethrough, each passageway 70 extending from a forward face 72 of the connector body 8 and communicating with a single terminal-receiving cavity 48. The passageways 70 are each defined by internal sidewalls 74 as best illustrated by FIG. 4, and each sidewall 74 is structured having an outwardly flared planar bottom surface 76. A planar sidewall 78, not having the above flared surface portion, defines one side of the passageway as indicated.

The subject connector assembly 2, as shown in FIG. 1, is intended to matingly plug onto a printed circuit board 80 having parallel rows of pins 82 projecting outwardly therefrom. A pair of polarizing pins 84 are provided at the ends of one row of pins 82, and are intended to serve a key-in function described in detail below. The present connector assembly is intended to terminate a flat transmission cable 86 comprised of alternately disposed parallel dual ground wires 88 and signal conductors 90. The ground conductors 88 and signal conductors 90 are encased with an outer sheath 92 typically extruded from plastics material. While the present invention has specific utility in terminating the cable illustrated in FIG. 1, it should be appreciated that other flat transmission cables having different configurations could also be terminated according to the teachings herein set forth.

Figure 6:
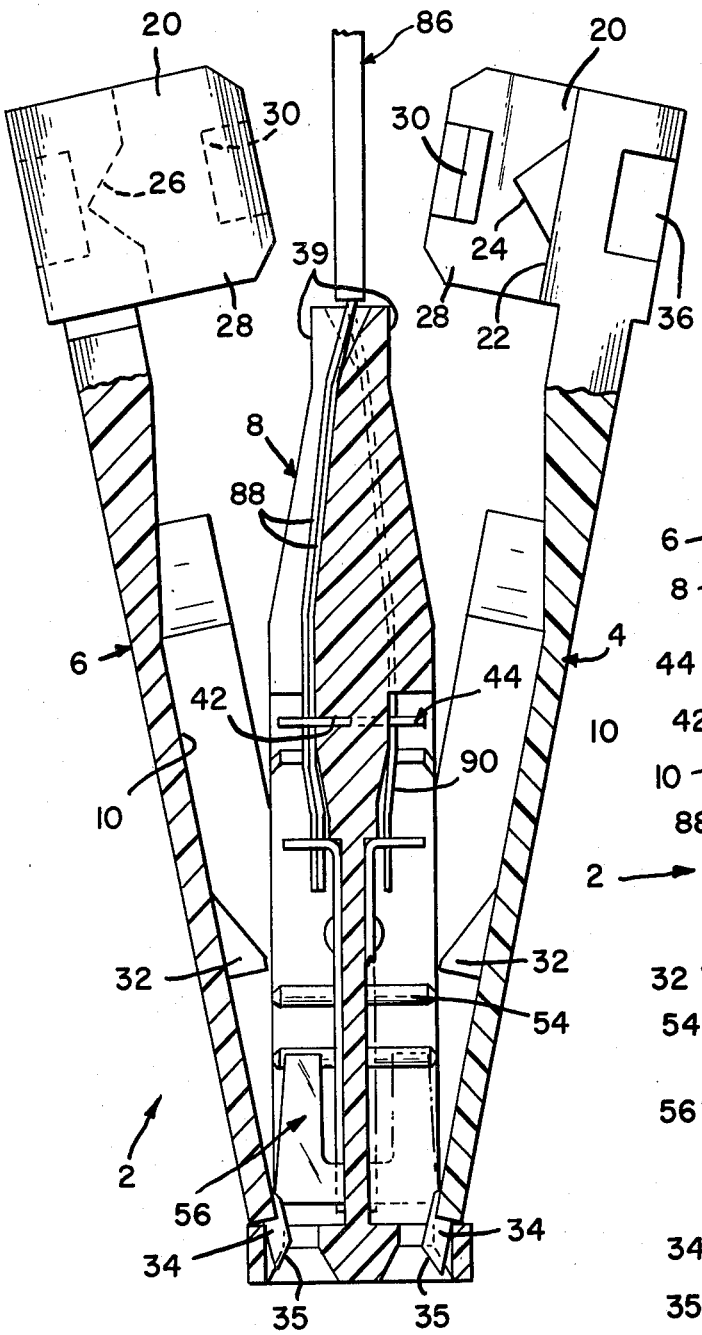
FIG. 6 is a transverse section view through the subject multi-piece connector, illustrating preliminary attachment of the connector covers to the connector block, prior to arcuate movement of the covers toward the block.
Figure 7:
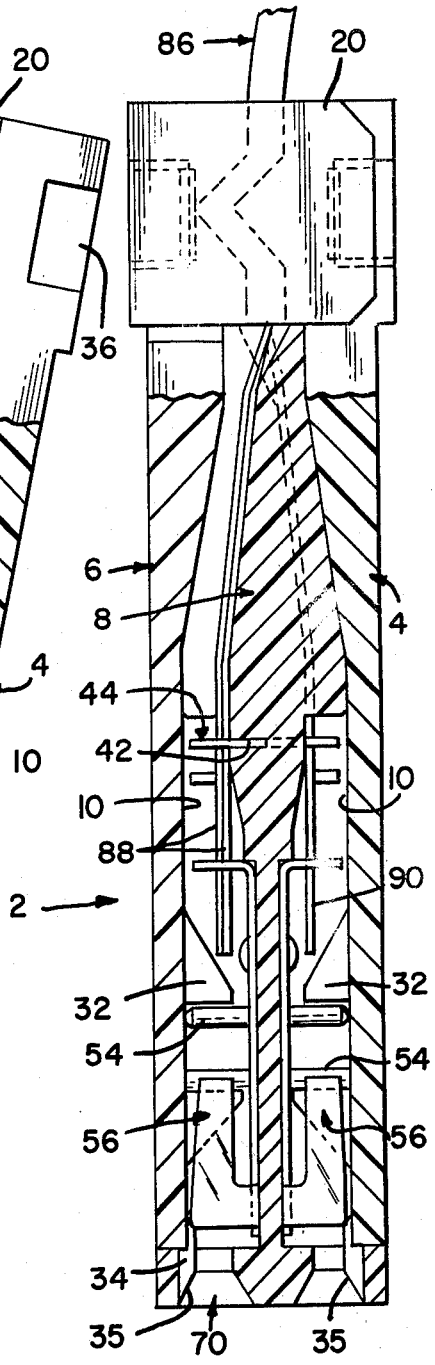

Assembly of the present invention proceeds as follows. Referring to FIGS. 3 and 6, the ground bus bar terminal 44 is inserted into the connector body slot 42. There positioned the ground bus terminal extends transversely of the body 8 between from one side thereof to the other side. The plurality of terminal members 56 are likewise inserted into the connector body 8, and each terminal 56 is positioned in one terminal-receiving cavity 48. It will be appreciated that each terminal 56 is intended to terminate one of the signal conductors 90, and the ground conductors 88 are terminated by the ground bus bar terminal 44. Resultingly, the cable conductors are positioned on both sides of the connector block 8 as shown.

Figure 7:
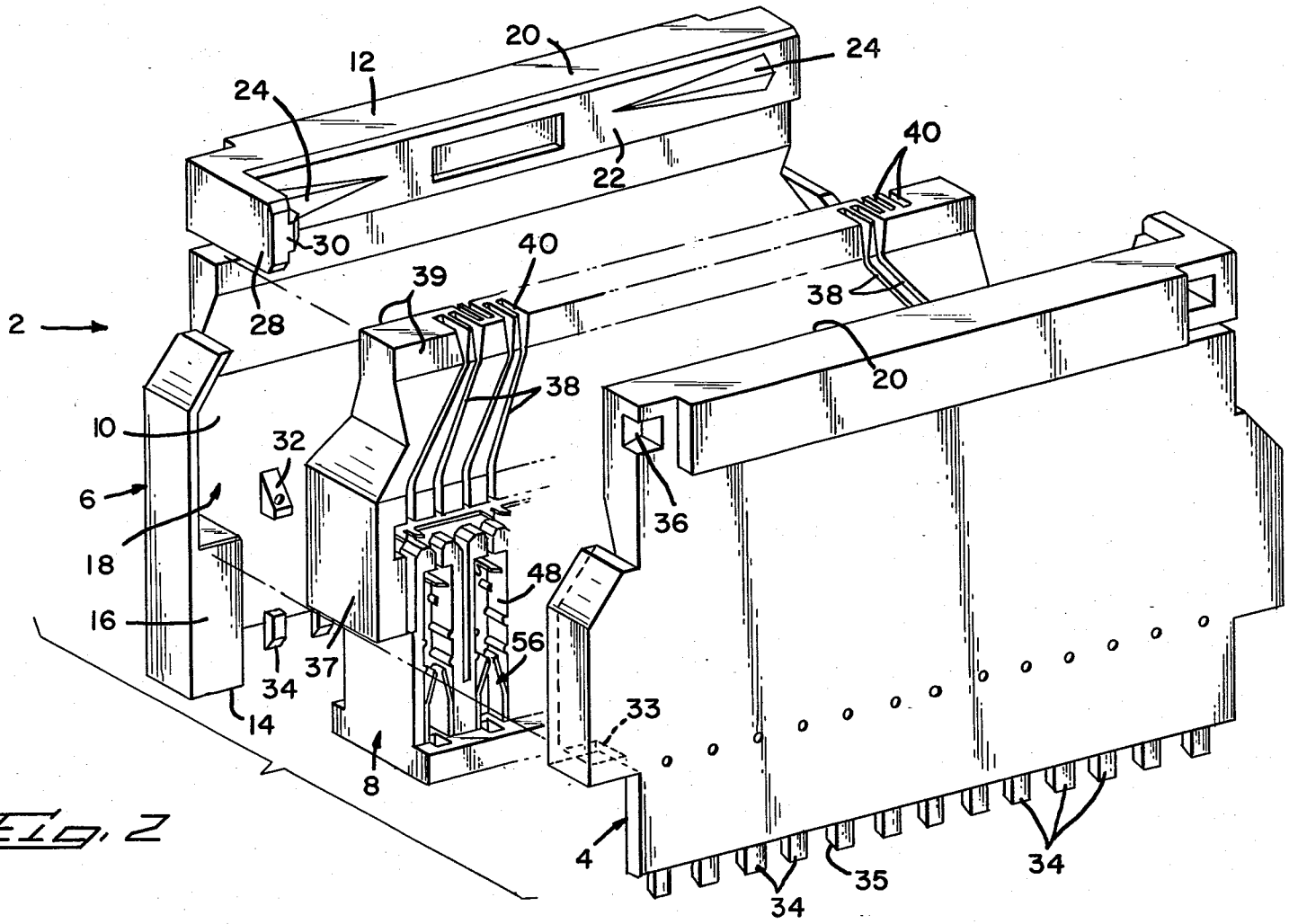
FIG. 7 is a transverse section view through the subject multi-piece connector as shown in FIG. 1, taken along the line 7—7.
Figure 5:
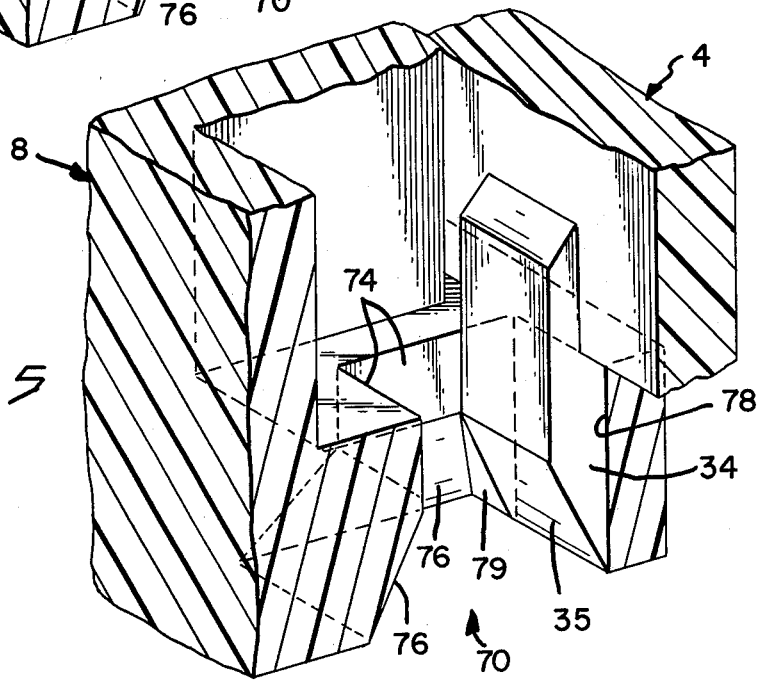
FIG. 5 is a transverse section view similar to that of FIG. 4, illustrating final assembled positionment of the stud projection in the receptacle passageway.

Referring next to FIGS. 4 and 6, the cover members 4,6 are attached to the connector block 8 as shown, with the stud projections 34 inserted into respective passageways 70. Thereafter, as illustrated by FIGS. 5 and 7, the covers 4,6 are arcuately rotated toward the connector block 8 until brought into abutting alignment against the connector block. The covers 4,6, in the assembled condition, enclose the contact-receiving cavities of the connector block, and latch at a rearward end to each other to secure the cover members to the connector block.

Upon rotation of the cover members toward the connector block, the stud projections 34 are brought into contiguous abuttment against the planar surfaces 78 of the receptacle passageways 70. An undercut portion 79 is provided, and the flared surface 35 of each stud projection is positioned alongside of the undercut 79 to comprise a continuous flared surface. It will be appreciated that the stud projections in the assembled condition project forward to a forward end of the connector block, and cooperate with the flared surfaces 76 of the receptacle passageways 70 to define a funnel-shaped profile for guided receipt of a terminal pin therethrough. In summary, the cover members 4,6 serve to enclose the contact-receiving passageways, and further function to provide forward structural means for interfitting with the connector block, and cooperatively defining in conjunction with flared surfaces of the connector block, a funnel-shaped entry.

While the above description of the preferred embodiment exemplifies the principles of the subject invention, other embodiments which would be apparent to one skilled in the art and which utilize the teachings herein set forth are intended to be within the scope and spirit of the subject invention.

What is claimed is:

1. A multi-piece connector assembly comprising:

a connector block having a row of contact receiving cavities within a side surface of said block, said block having a like row of receptacle passageways through a frontal face of said block, each defined by interior side walls and each communicating with a respective one of said cavities;

a cover body for positionment over said side of said block to enclose said contact receiving cavities, and having forwardly projecting means at a forward end for insertion into said row of receptacle passageways and extending to said frontal face, whereby securing said forward end of said cover body to said block.

2. A connector assembly as set forth in claim 1, wherein one of said interior sidewalls being planar, and the other of said sidewalls each having an outwardly flared surface portion contiguous to said frontal face of said block;

said projecting means of said cover body comprising stud projections, serially spaced across a forward end of said cover body, each having an outwardly facing planar side for positionment against said one interior sidewall, and each said stud projection having an outwardly flared surface at a remote end facing inwardly in cooperation toward said flared surfaces of said other of said sidewalls, whereby said passageways of said block having a funnel-shaped profile for guided receipt of mating contact means therethrough.

3. An electrical connector for terminating multiconductors of an electrical cable, comprising:

connector block means having a forward section and terminal-receiving cavities, said forward section having passageways extending therethrough in respective communication with the terminal-receiving cavities;

electrical terminal members disposed respectively in said terminal-receiving cavities, said electrical terminal members having receptacle sections facing said passageways and conductor-terminating sections for terminating electrical conductors therein in a lateral direction relative to said connector block means;

cover means for enclosing said terminal-receiving cavities and the terminated electrical terminal members, said cover means including projection means along a front end thereof for matable engagement with the respective passageways and extending to a front surface of said front section thereby securing the front end of said cover means to said connector block means and forming part of said passageways; and latching means for latching said cover means in position on said connector block means.

4. An electrical connector as set forth in claim 3 wherein each of said passageways has one planar surface and the other surfaces include flared surfaces that flare inwardly from said front surface of said front section, each of said projection means having a planar outer surface extending along the respective one planar surface and an inner flared surface complementary with the other flared surfaces, said flared surfaces of each of said passageways defining a funnel-shaped entry.

5. An electrical connector as set forth in claim 3 wherein said latching means are located on said cover means and are latachably engageable to secure said cover means on said connector block means.

6. An electrical connector as set forth in claim 5 wherein strain relief means are provided on said cover means for engagement with the electrical cable.

7. An electrical connector as set forth in claim 3 wherein said connector block means has conductor-receiving channel means disposed therein for receiving the electrical conductors therein, said channel means being in communication respectively with said terminal-receiving cavities, said cover means extending across said channel means to maintain the electrical conductors therein.

8. An electrical connector as set forth in claim 7 wherein ground bus bar means is disposed in said connector block means between said channel means and said terminal-receiving cavities.

* * * * *